US008157096B2

(12) United States Patent
Liao et al.

(10) Patent No.: US 8,157,096 B2
(45) Date of Patent: Apr. 17, 2012

(54) FOLDABLE AIR CUSHION

(75) Inventors: Chian Hua Liao, Sincian (TW); Yao Sin Liao, Sincian (TW); Bo Xin Jian, Sincian (TW)

(73) Assignee: Chieh Hua Liao, Sindian (TW)

( * ) Notice: Subject to any disclaimer, the term of this patent is extended or adjusted under 35 U.S.C. 154(b) by 264 days.

(21) Appl. No.: 11/609,218

(22) Filed: Dec. 11, 2006

(65) Prior Publication Data

US 2007/0295633 A1 Dec. 27, 2007

(30) Foreign Application Priority Data

Jun. 23, 2006 (TW) ..... 95122625 A

(51) Int. Cl.
*B65D 81/02* (2006.01)

(52) U.S. Cl. ..... 206/522; 383/3

(58) Field of Classification Search ..... 206/522, 206/521; 383/3, 66
See application file for complete search history.

(56) References Cited

U.S. PATENT DOCUMENTS

| | | | | |
|---|---|---|---|---|
| 5,263,587 | A * | 11/1993 | Elkin et al. | 206/522 |
| 5,469,966 | A * | 11/1995 | Boyer | 206/522 |
| 5,911,657 | A * | 6/1999 | Meiners | 5/710 |
| 6,629,777 | B2 * | 10/2003 | Tanaka et al. | 383/3 |
| 6,755,568 | B2 * | 6/2004 | Malone et al. | 383/3 |
| 7,000,767 | B2 | 2/2006 | Tanaka et al. | |
| 2004/0211697 | A1 * | 10/2004 | Nakano | 206/522 |
| 2004/0232031 | A1 * | 11/2004 | Nishi et al. | 206/521 |
| 2005/0109656 | A1 * | 5/2005 | Ishizaki | 206/522 |
| 2005/0189257 | A1 * | 9/2005 | Chen et al. | 206/522 |
| 2005/0263425 | A1 * | 12/2005 | Tanaka et al. | 206/522 |
| 2006/0032779 | A1 * | 2/2006 | Tanaka et al. | 206/522 |
| 2006/0144745 | A1 * | 7/2006 | Abe | 206/522 |
| 2006/0278554 | A1 * | 12/2006 | Tanaka et al. | 206/522 |
| 2007/0051655 | A1 * | 3/2007 | Yoshifusa | 206/522 |
| 2007/0051656 | A1 * | 3/2007 | Hsin | 206/522 |
| 2007/0065047 | A1 * | 3/2007 | Kojima et al. | 383/3 |
| 2007/0084745 | A1 * | 4/2007 | Yoshifusa | 206/522 |
| 2007/0090013 | A1 * | 4/2007 | Yoshifusa et al. | 206/522 |
| 2007/0163916 | A1 * | 7/2007 | Yoshifusa | 206/522 |

(Continued)

FOREIGN PATENT DOCUMENTS

JP 01-045277 A 2/1989

(Continued)

*Primary Examiner* — J. Gregory Pickett
*Assistant Examiner* — Ernesto Grano
(74) *Attorney, Agent, or Firm* — Rabin & Berdo, P.C.

(57) ABSTRACT

A foldable air cushion includes a main air tube piece composed by a main body and buffer walls; and side air tube pieces configured adjacent to the main air tube piece and each composed by a side body and folding portions. A bending line is configured between the main body and the buffer walls, and the side body and the folding portions. A folding line is configured between the main air tube piece and the side air tube pieces, while the folding areas are configured on the side air tube piece adjacent to the intersection of the bending line and the folding line. When the main air tube piece is bended along the bending line, the side bodies of the side air tube pieces are folding along the folding areas, and the side air tube pieces are folded along the folding line, a containing space will be formed between the main air tube piece and the side air tube pieces. Therefore, the foldable air cushion has the protection effect of six-side buffering for the article held in the containing space, and effectively reduces the manufacturing cost.

22 Claims, 14 Drawing Sheets

U.S. PATENT DOCUMENTS

2007/0246394 A1* 10/2007 Yoshifusa ..... 206/522

FOREIGN PATENT DOCUMENTS

| | | | | |
|---|---|---|---|---|
| JP | 01-199857 | A | | 8/1989 |
| JP | 06-067370 | U | | 9/1994 |
| JP | 08-282736 | A | | 10/1996 |
| JP | 09-042500 | A | | 2/1997 |
| JP | 09-086566 | A | | 3/1997 |
| JP | 2000-079951 | A | | 3/2000 |
| JP | 2001-039474 | A | | 2/2001 |
| JP | 2002-037341 | A | | 2/2002 |
| JP | 2002-234577 | A | | 8/2002 |
| JP | 2004262471 | A | * | 9/2004 |
| JP | 2004-306407 | A | | 11/2004 |
| JP | 2006-069621 | A | | 3/2006 |
| TW | M278659 | | | 10/2005 |
| WO | WO 2004074133 | A1 | * | 9/2004 |

* cited by examiner

FOLDABLE AIR CUSHION

BACKGROUND OF THE INVENTION

1. Field of Invention

The present invention relates to an air cushion, and more particularly, to a foldable air cushion for folding as a container directly to load articles.

2. Related Art

Nowadays air bubble sheets or polystyrene are widely used to wrap articles, but still cause problems of poor buffering effect or environment pollution. To solve the drawbacks, an air-packing bag made of resin films is developed. The air tubes are formed by thermal-sealing. A pneumatic hole is also configured for filling air. After air is filled into the air tube through the pneumatic hole, the air-packing bag may be used as a buffer material of internal packing.

Please refer to FIG. 1. An air-packing bag 10 is composed by plural air tubes 11, which are bended to form a first sidewall 12 and a second sidewall 13. However, this type of air-packing bag can only provide four-side buffer forces of the top, bottom, front and rear sides. It has no protection effect for lateral buffering. When all the six sides of a wrapped article need the buffering protection, two of the air-packing bags will be needed to combine together, as disclosed in U.S. Pat. No. 7,000,767.

Please refer to FIG. 2. The first sidewall 12 and the second sidewall 13 have film 14 at their two sides. Through thermal-sealing means, the first sidewall 12 and the second sidewall 13 are coupled with the film 14 to form a containing space 15 therein. Then a wrapped article is loaded into the containing space 15 of the air-packing bag 10. However, when the thermal-sealing means couple the film 14 to a position that is too close to the first sidewall 12 or the second sidewall 13, the first sidewall 12 and the second sidewall 13 will push and press each other, thereby causing the reduction of the containing space in the air-packing bag 10. On the other hand, if the thermal-sealing means couple the film 14 to a position that is too far away from the first sidewall 12 or the second sidewall 13, the first sidewall 12 and the second sidewall 13 will has a gap in between, thereby causing no buffer protection from the air tubes 11 can be used for the wrapped article at the lateral sides of the air-packing bag 10. Besides, the operation procedures of the thermal-sealing means to couple the film 14 are more complicated, which make the manufacturing cost of air-packing bag 10 substantially increase. Moreover, common external packing boxes are rectangular cardboard boxes. Arc protrusions 16, considerably protruding, will be formed at the two lateral sides of the air-packing bag 10 while thermal-sealing the film 14. That makes the air-packing bag 10 very difficult to be loaded into the rectangular cardboard box after wraps the wrapped article, as disclosed in U.S. Pat. No. 6,629,777.

In Taiwan Patent No. M278659 "Air tube Piece for Cushion", an air-packing bag is configured with cutting lines by poking-line means to be torn apart and folded as a six-side buffering container. Not only the operation processes are increased, but also raising the manufacturing cost of the air-packing bag.

Therefore, to improve the structure of the air-packing bag to form a containing space without using thermal-sealing means to couple the film, avoiding various-sized containing spaces and poor buffering protection at two lateral sides, solving the drawback that the air-packing bag cannot be easily loaded into the rectangular cardboard box, and further reducing the manufacturing cost of the air-packing bag, becomes an issue that the inventor of the present invention and those practicing in the art are eager to develop.

SUMMARY OF THE INVENTION

Accordingly, the present invention provides a foldable air cushion.

The present invention is a foldable air cushion including a main air tube piece, a side air tube piece, a bending line, a folding line and at least one folding area. The main air tube piece includes a main body and a buffer wall connected to the main body. The side air tube piece, located adjacent to the main air tube piece, includes a side body and a folding portion connected to the side body. The bending line is located between the main body, the buffer wall, the side body and the folding portion. The folding line is located between the main air tube piece and side air tube piece. The folding area is located on the side air tube piece, adjacent to the intersection of the bending line and the folding line.

When the main air tube piece and the side air tube piece are filled with air and expanding, the buffer wall of the main air tube piece is first bended along the bending line while the side body of the side air tube piece is folded along the folding area. Then the side air tube piece is bended along the folding line to form a containing space between the main air tube piece and the side air tube piece. Accordingly, the six-side buffering effect is provided to the held article in the containing space, along with effective reduction of the manufacturing cost. The foldable air cushion is also easily loaded into the external packing box with the held article.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
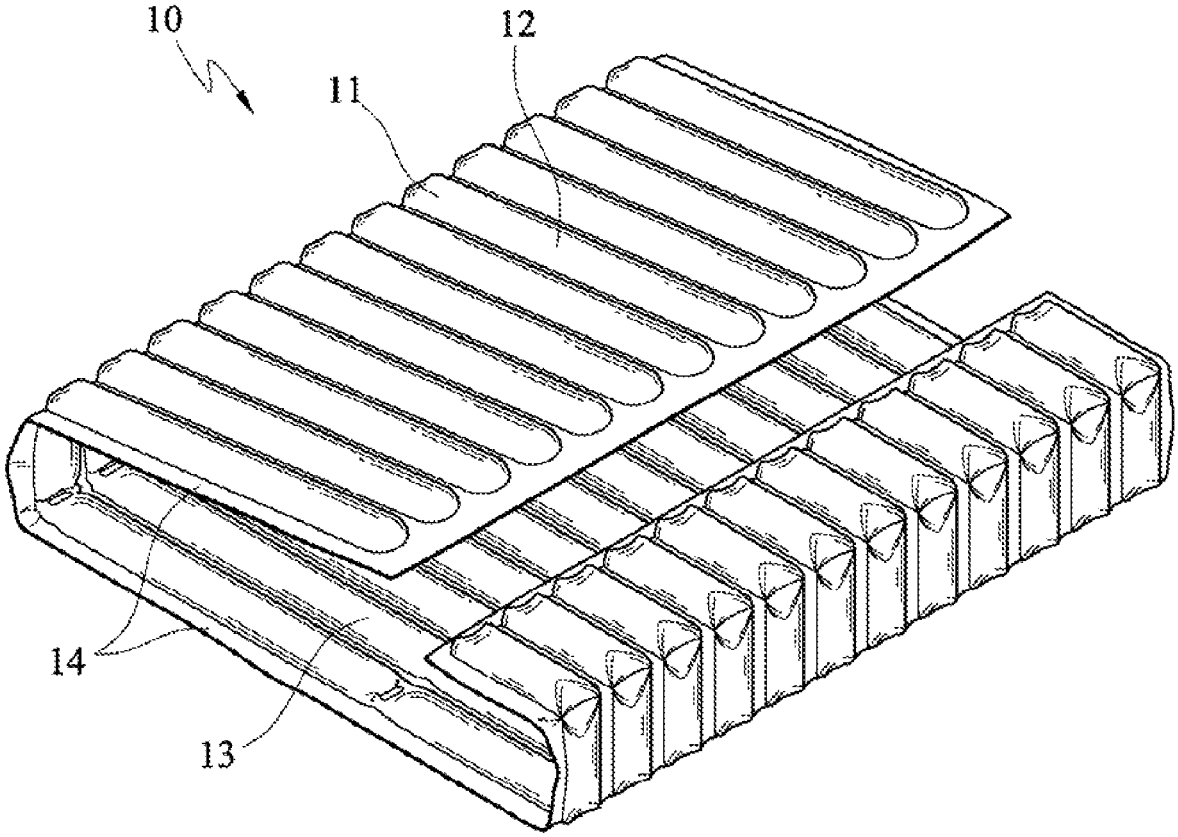
FIG.1 (PRIOR ART)
FIG. 1 is an explanatory diagram for an air-packing bag in the prior art before thermal-sealing.
Figure 2:
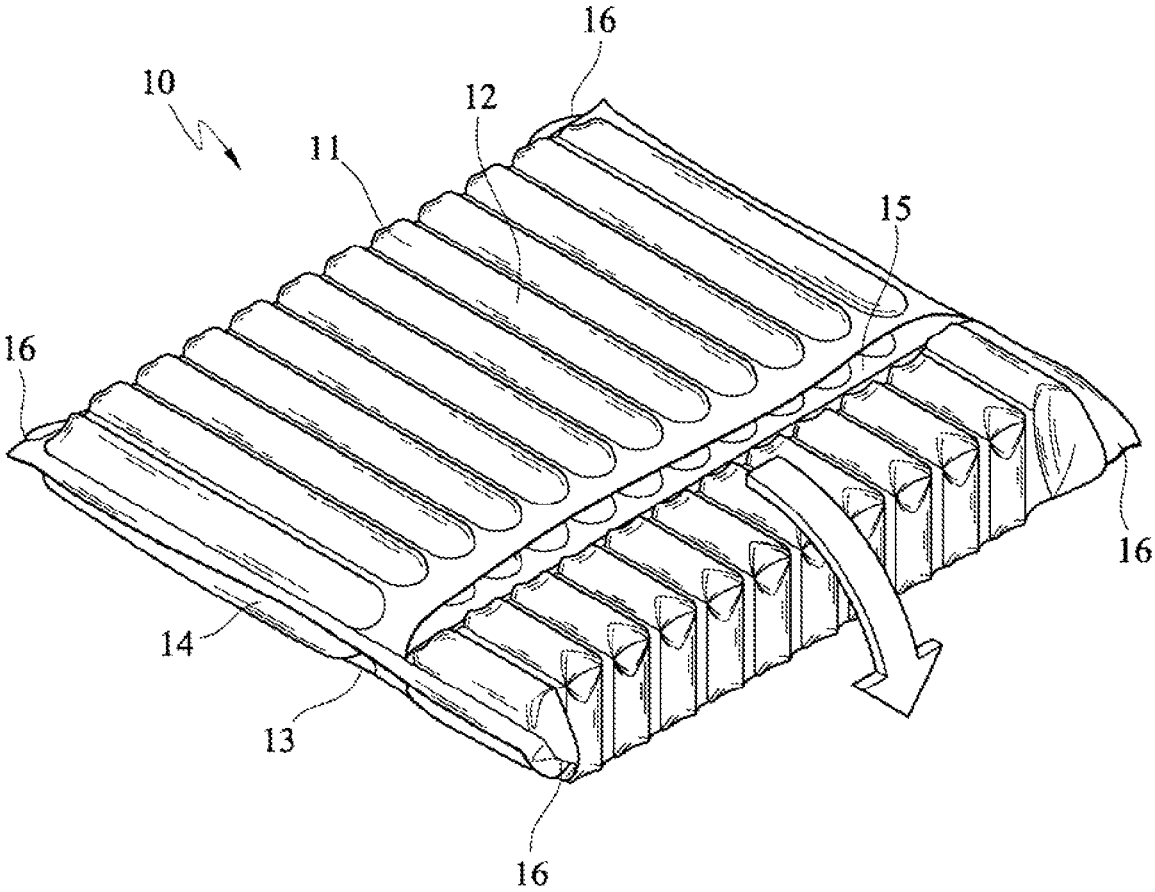
FIG.2 (PRIOR ART)
FIG. 2 is an explanatory diagram for an air-packing bag in the prior art after thermal-sealing.
Figure 3:
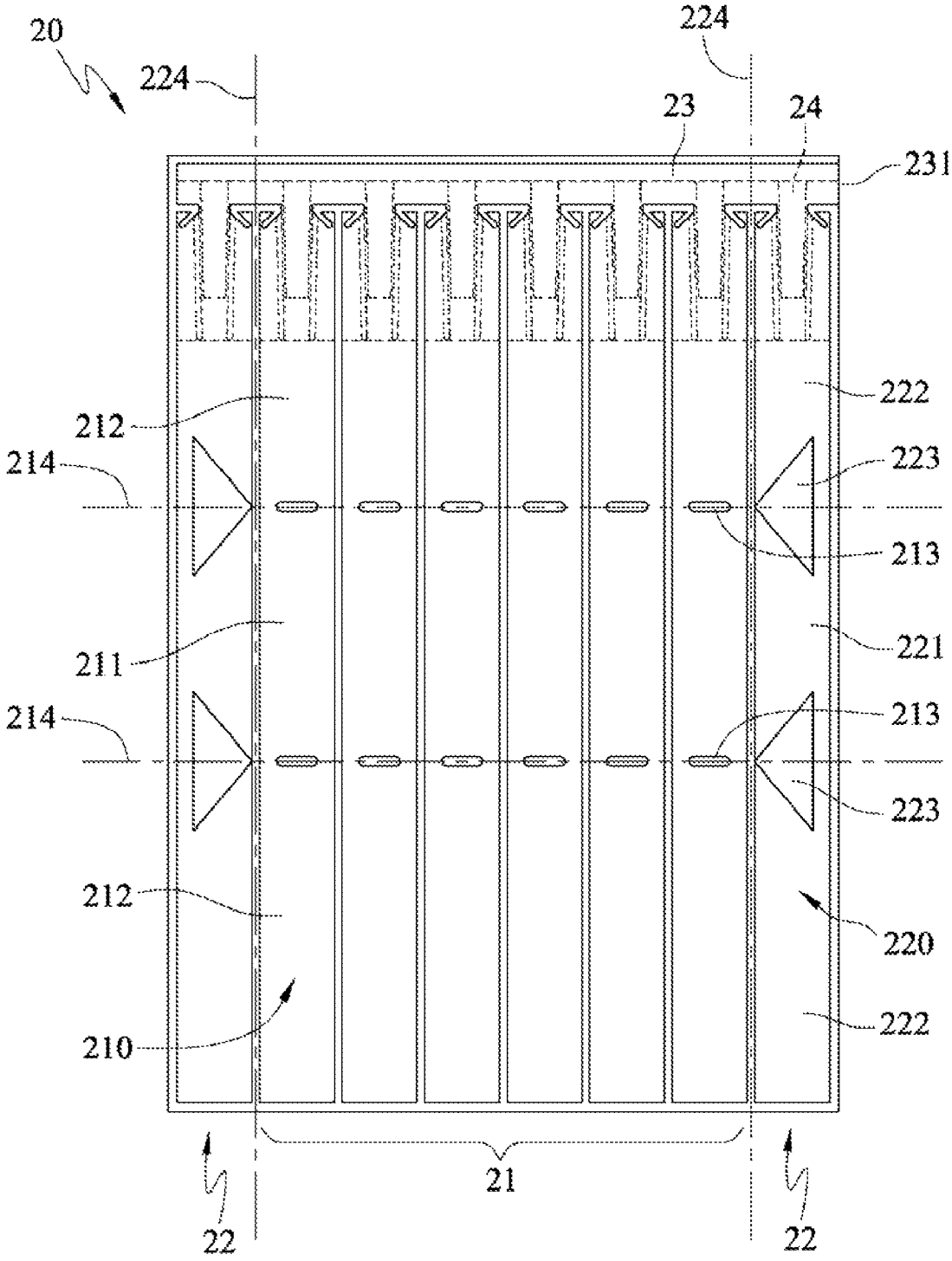
FIG. 3 is an explanatory diagram of the first preferred embodiment in the present invention before filling air.
Figure 4:
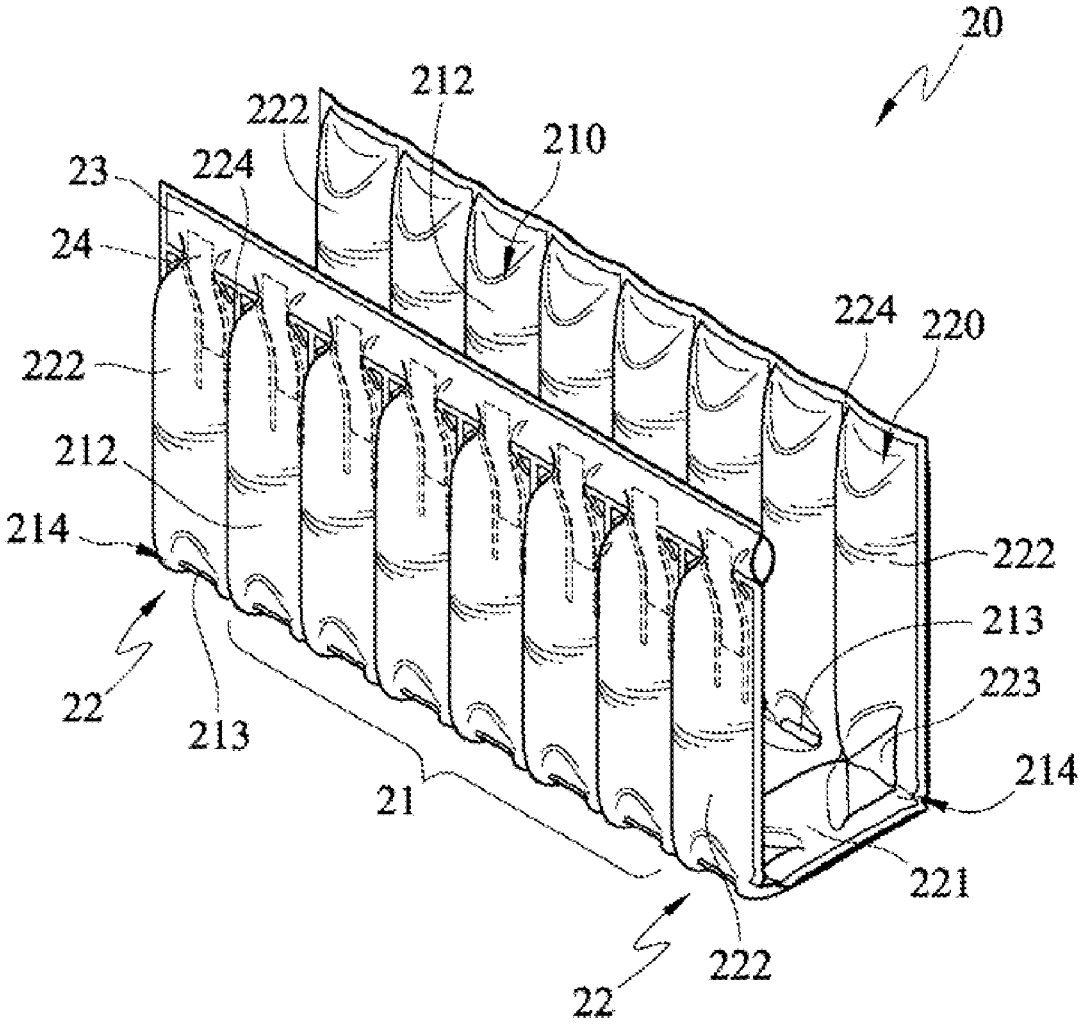
FIG. 4 is an explanatory diagram of the first preferred embodiment in the present invention after filling air.
Figure 5:
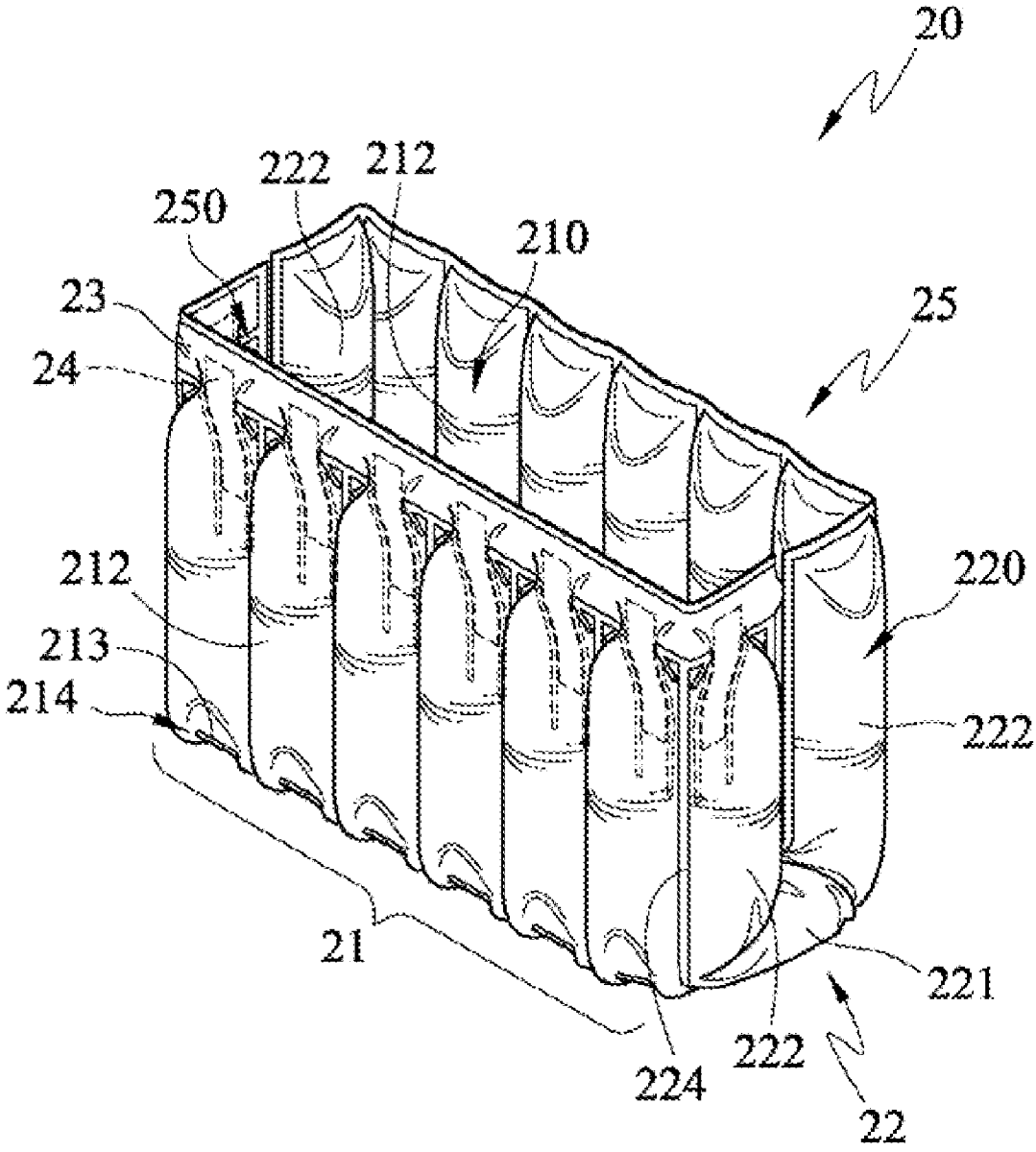
FIG. 5 is an explanatory diagram for FIG. 4, proceeding folding operation.

Please refer to a foldable air cushion according to the first preferred embodiment illustrated in FIGS. 3, 4 and 5.

FIG. 3 is an explanatory diagram before filling air; FIG. 4 an explanatory diagram after filling air; and FIG. 5 is an explanatory diagram showing the folding operation in FIG. 4.

The foldable air cushion 20 includes a main air tube piece 21 and a side air tube piece 22.

The main air tube piece 21 is composed by plural main air tubes 210. Each of the main air tubes 210 has a main body 211. At the two lateral sides of the main body 211, buffer walls 212 are connected thereon respectively. Bending points 213 are configured between the buffer wall 212 and the main body 211. The bending line 214 is formed by bending along the bending points 213. The shape of the bending point 213 may be triangular, elliptical, circular, square or other irregular shapes.

The side air tube piece 22 is located adjacent to the main air tube piece 21. A folding line 224 is configured between the side air tube and the main air tube piece 21. The side air tube piece 22 is composed by the side air tubes 220. Each of the side air tubes 220 has a side body 221. At the two lateral sides of the side body 221, a folding portion 222 is connected thereon respectively. The side body 221 is adjacent to the main body 211, while the folding portion 222 is adjacent to the buffer wall 212. The side body 221 and the folding portion 222 have folding areas 223 adjacent to the intersection of the folding line 224 and the bending line 214. The shape of folding area 223 may be triangular, elliptical, circular, square or other irregular shapes.

According to the structure disclosed by the present invention, the main air tube 210 and side air tube 220 may have the same or different lengths, or have mixed air tubes with the same or different lengths. The widths of the main air tube 210 and side air tube 220 may be the same or different, while air tubes with the same or different widths may be mixed. Furthermore, the main air tube 210 and the side air tube 220 may be straight-shaped, curve-shaped or the mixture of the former two. The shapes of the main air tube 210 and the side air tube 220 may be lengthwise tubular, rhomboidal, circular, square, polygonal or other irregular shapes.

The above-described foldable air cushion 20 further includes a pneumatic passage 23. At one side of the pneumatic passage 23, a pneumatic hole 231 is configured thereon. The pneumatic passage 23 connects with the main air tube 210 and the side air tube 220. And a check valve 24 is configured at the intersection of the main air tube 210 and the side air tube 220, thereby using the air of the pneumatic hole 231 to expand the pneumatic passage 23, open the check valve 24 and enter the main air tube 210 and the side air tube 220 eventually. The check valve 24 will stay closed in accordance with the air pressure of the main air tube 210 or the side air tube 220, to keep the expanding state of air-filling without leaking air. Therefore the main air tube 210 and the side air tube 220 will remain the effect of buffering protection.

After the main air tube piece 21 and the side air tube piece 22 are expanding by way of air-filling, the main air tube piece 21 is bended along the bending points 213 to allow the main body 211 and the two buffer walls 212 to form a U-shaped body. When the side body 221 of the side air tube piece 22 is folded along the folding area 223 and the side air tube piece 22 is bended along the folding line 224, a containing space 250 will be formed between the side body 221 of the side air tube piece 22, the two folding portions 222, the main body 211 of the main air tube piece 21 and the two buffer walls 212. Meanwhile the folding area 223 of the side air tube piece 22 will be loaded in the containing space 250. The included angle at the folded position of the main air tube piece 21 and the side air tube piece 22 is about a right angle, to enable the foldable air cushion 20 to form a rectangular body.

By bending and folding ways, the containing space 250 is formed between the main air tube piece 21 and side air tube piece 22. The side air tube piece 22 may be directly bended to achieve the function of lateral buffering protection without the operation processes of thermal-sealing or configuring cutting lines to effectively reducing the manufacturing cost. Besides, every containing space 250 will be bended and folded to form the same size, solving the various-size drawback in the prior art resulted from thermal-sealing.

Figure 6:
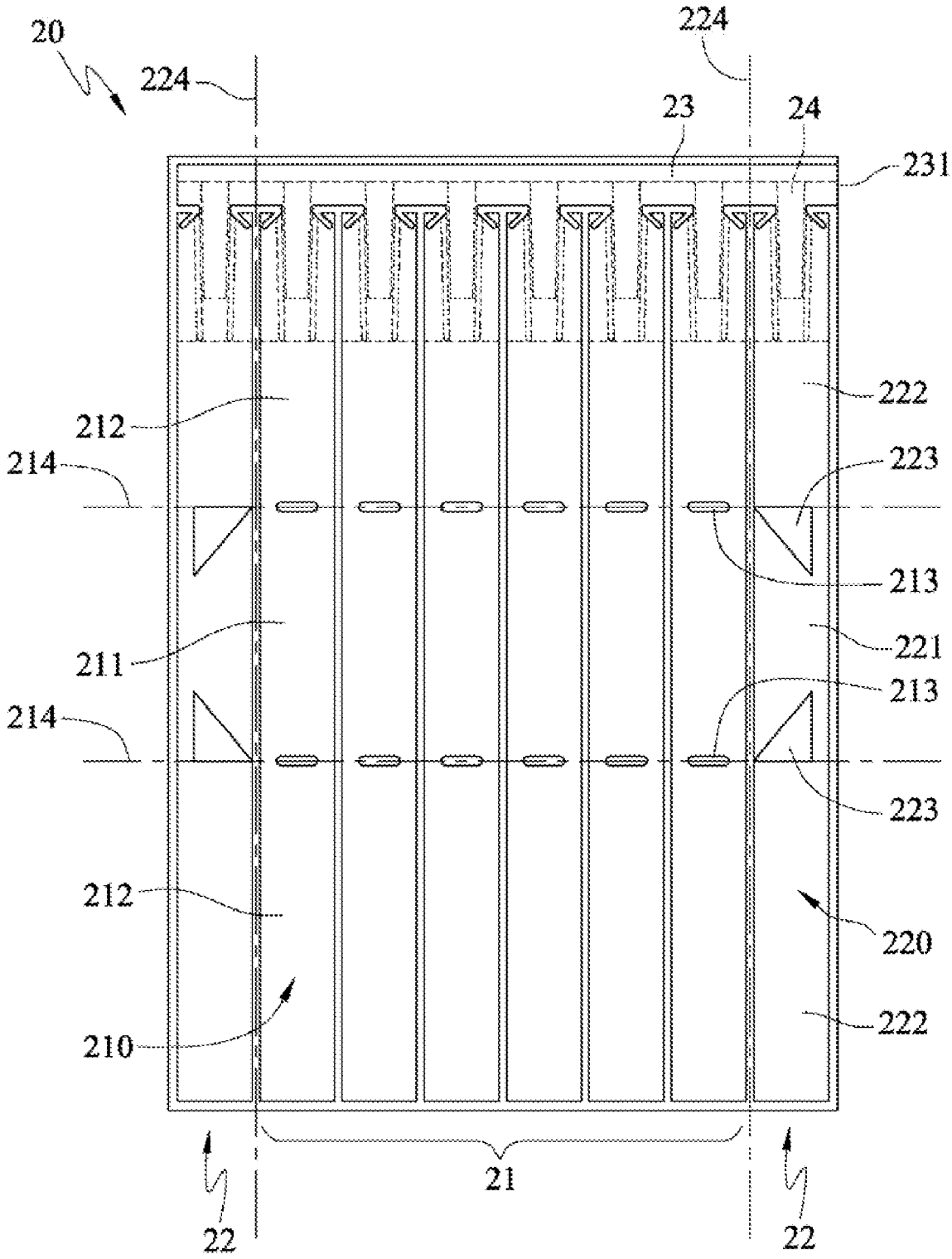
FIG. 6 is an explanatory diagram of the second preferred embodiment in the present invention before filling air.
Figure 7:
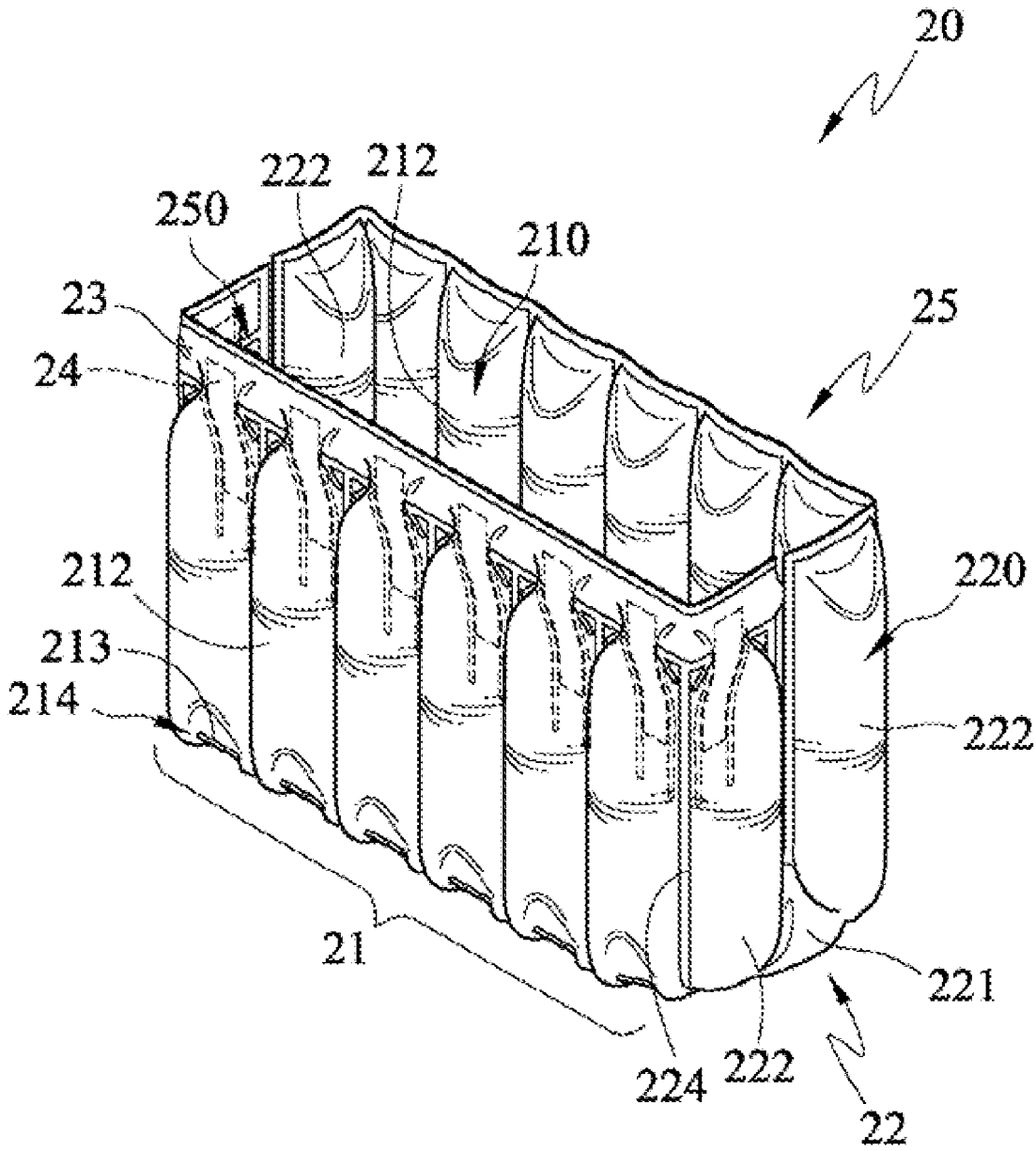
FIG. 7 is an explanatory diagram for FIG. 6, proceeding folding operation after filling air.

Please refer to FIGS. 6 and 7, which illustrate the second preferred embodiment. FIG. 6 is an explanatory diagram before filling air, while FIG. 7 is an explanatory diagram of folding operation after filling air.

The side body 221 of the side air tube piece 22 has folding areas 223 adjacent to the intersections of the folding line 224 and the bending lines 214. It is not necessary for the folding portions 222 to configure with the folding areas 223. By bending and folding ways, a containing space 250 may be formed between the side body 221 of the side air tube piece 22 and the two folding portions 222, and the main body 211 of the main air tube piece 21 and the two buffer walls 212. Meanwhile, at least one portion of the side body 221 is held in containing space 250.

Figure 8:
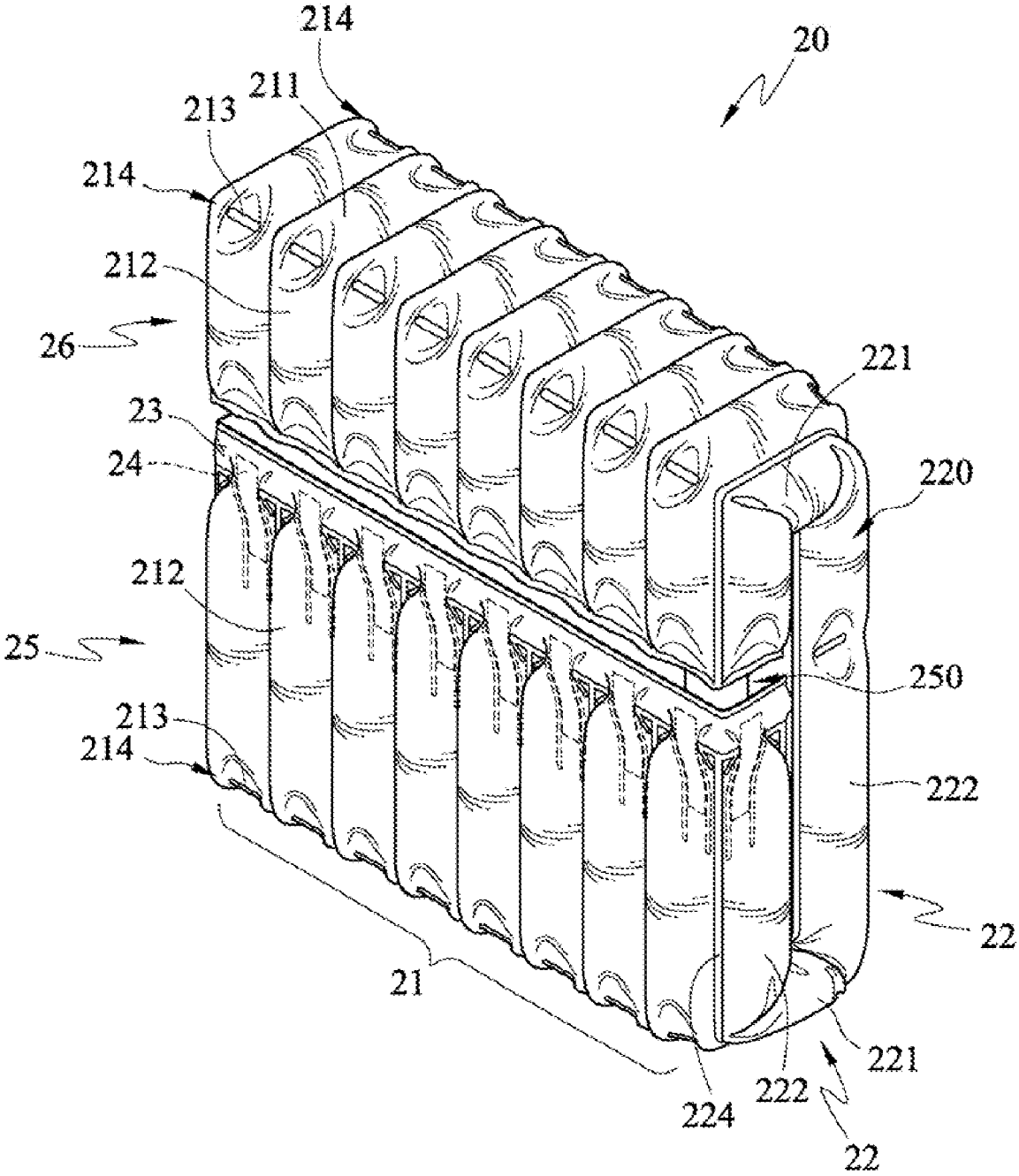
FIG. 8 is an explanatory diagram of the third preferred embodiment in the present invention.
Figure 9:
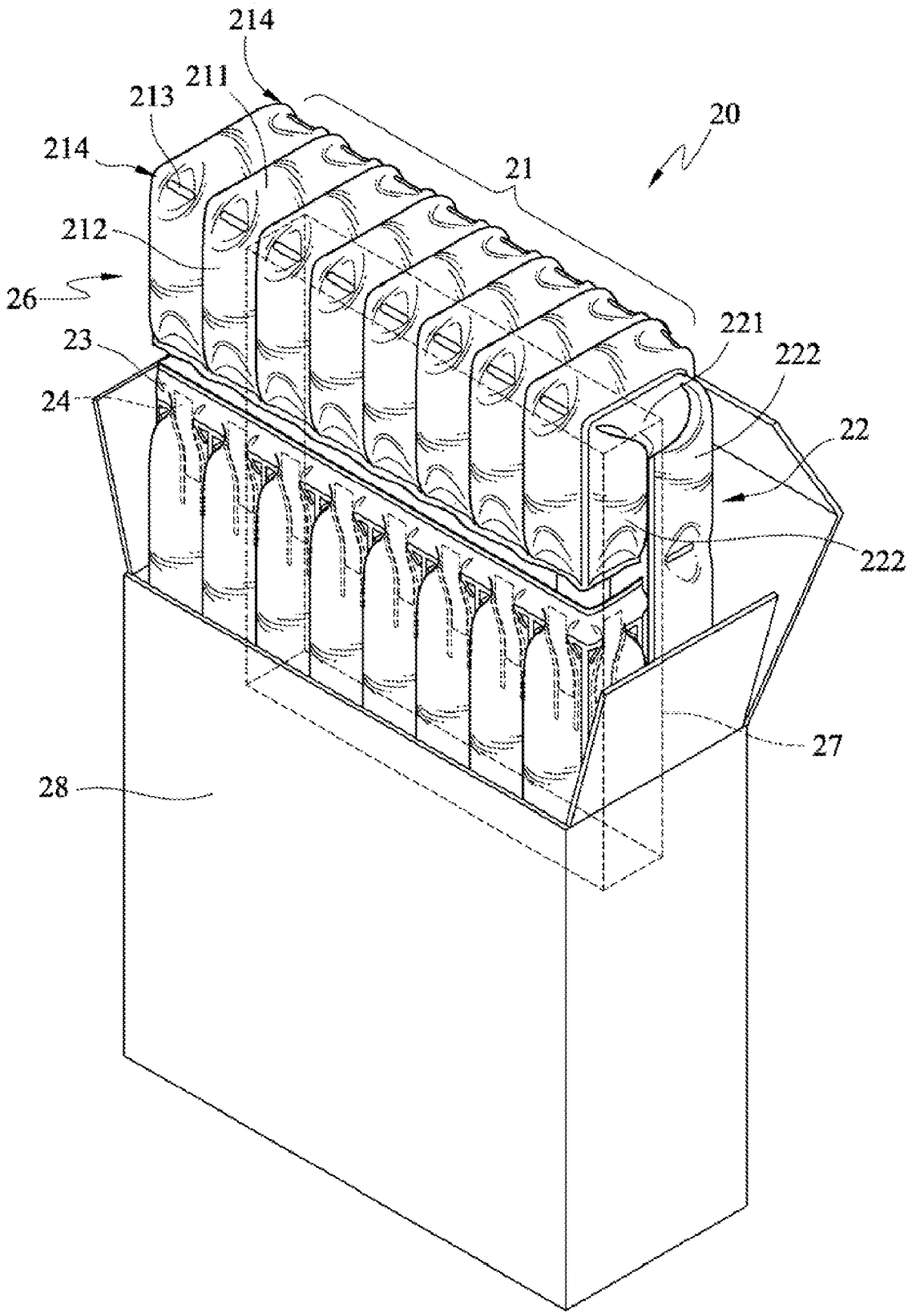
FIG. 9 is an explanatory diagram for FIG. 8, loading into a cardboard box after folding operation.

Please refer to FIGS. 8 and 9, which illustrate the third preferred embodiment. FIG. 8 is an explanatory diagram before folding operation, while FIG. 9 is an explanatory diagram of loading into a cardboard box after folding operation.

The main air tubes 210 of the main air tube piece 21 have two main bodies 211. A joint buffer wall 212 is configured between the two main bodies 211, while other buffer walls 212 are configured at the other sides of the main bodies 211 respectively. The side air tube 220 of the side air tube piece 22 has two side bodies 221. A shared folding portion 222 is configured between the two side bodies 221. And other folding portions 222 are configured at the other sides of the side bodies 221 respectively.

When the main air tube piece 21 and the side air tube piece 22 are expanding with air-filling, the buffer walls 212 of the main air tube piece 21 are bended along the bending points 213 to allow the two main bodies 211 and their buffer walls 212 to form a U-shaped body respectively. The side bodies 221 of the side air tube piece 22 are folded along the folding areas 223, along with the side air tube piece 22 folded along the folding line 224, thereby enable one side body 221 of the side air tube piece 22 and the folding portions 222, and one main body 211 of the main air tube piece 21 and the buffer walls 212 to form a box body 25 with a containing space 250. Meanwhile, the other side body 221 of the side air tube piece 22 and the folding portions 222, and the other main body 211 of the main air tube piece 21 and the buffer walls 212 may form a cover body 26. The box body 25 and the cover body 26 are combined as a rectangular body, without the protrusive arc protrusions resulted from thermal-sealing in the prior art.

When the held article 27 is loaded into the box body 25, the containing space 250 will contain the held article 27 with the main air tubes 210 and the side air tubes 220 packing externally to easily put into a cardboard box 28. During the transportation of the held article 27, the buffering effect will be generated through contacting and pressing from the main air tubes 210 and the side air tubes 220. That is not only to avoid scraping and hurting the surface of the held article 27, but also to achieve the objective that makes the held article 27 shake-proof and impact-proof at its six sides.

Figure 10:
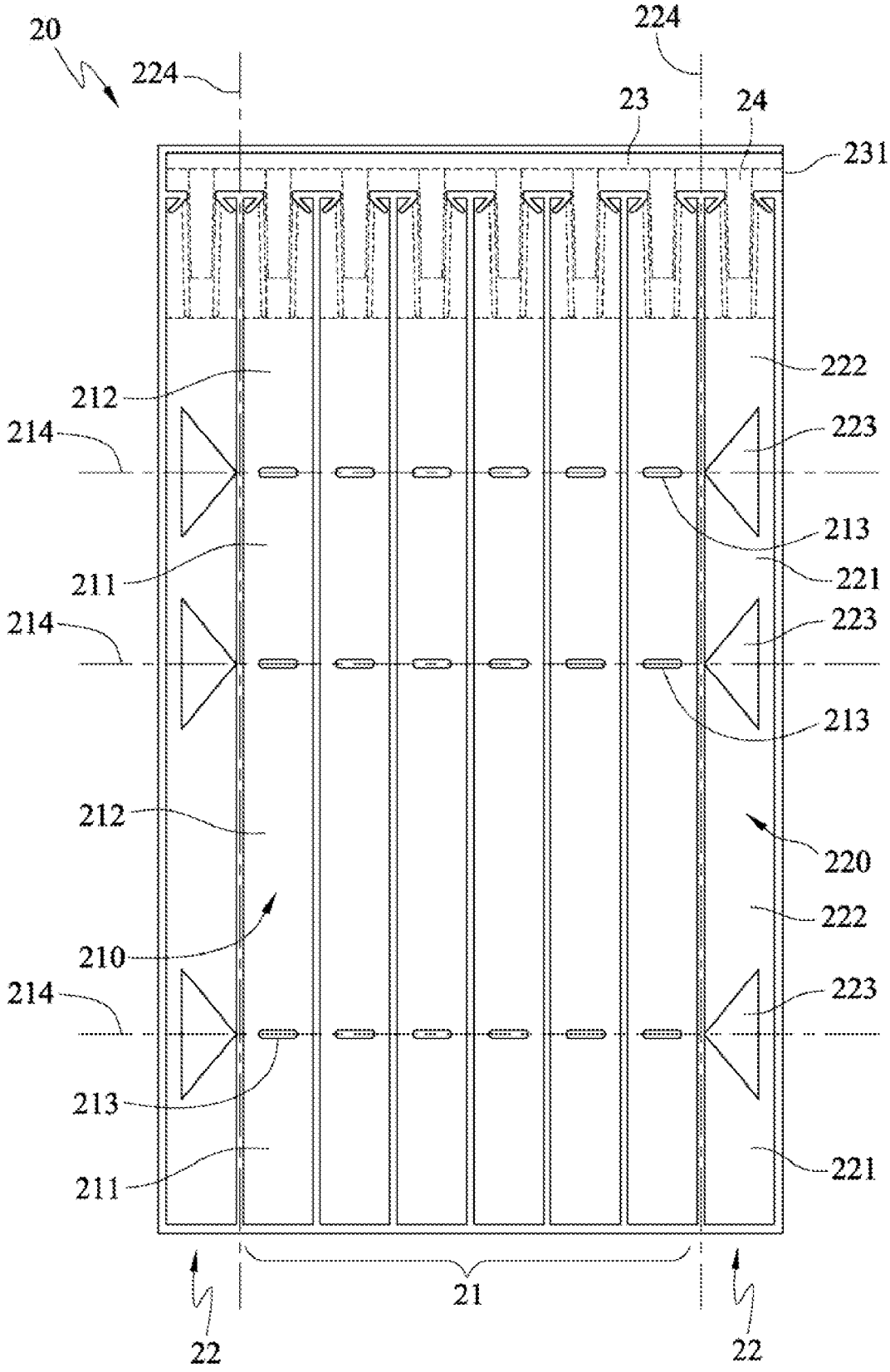
FIG. 10 is an explanatory diagram of the fourth preferred embodiment in the present invention.
Figure 11:
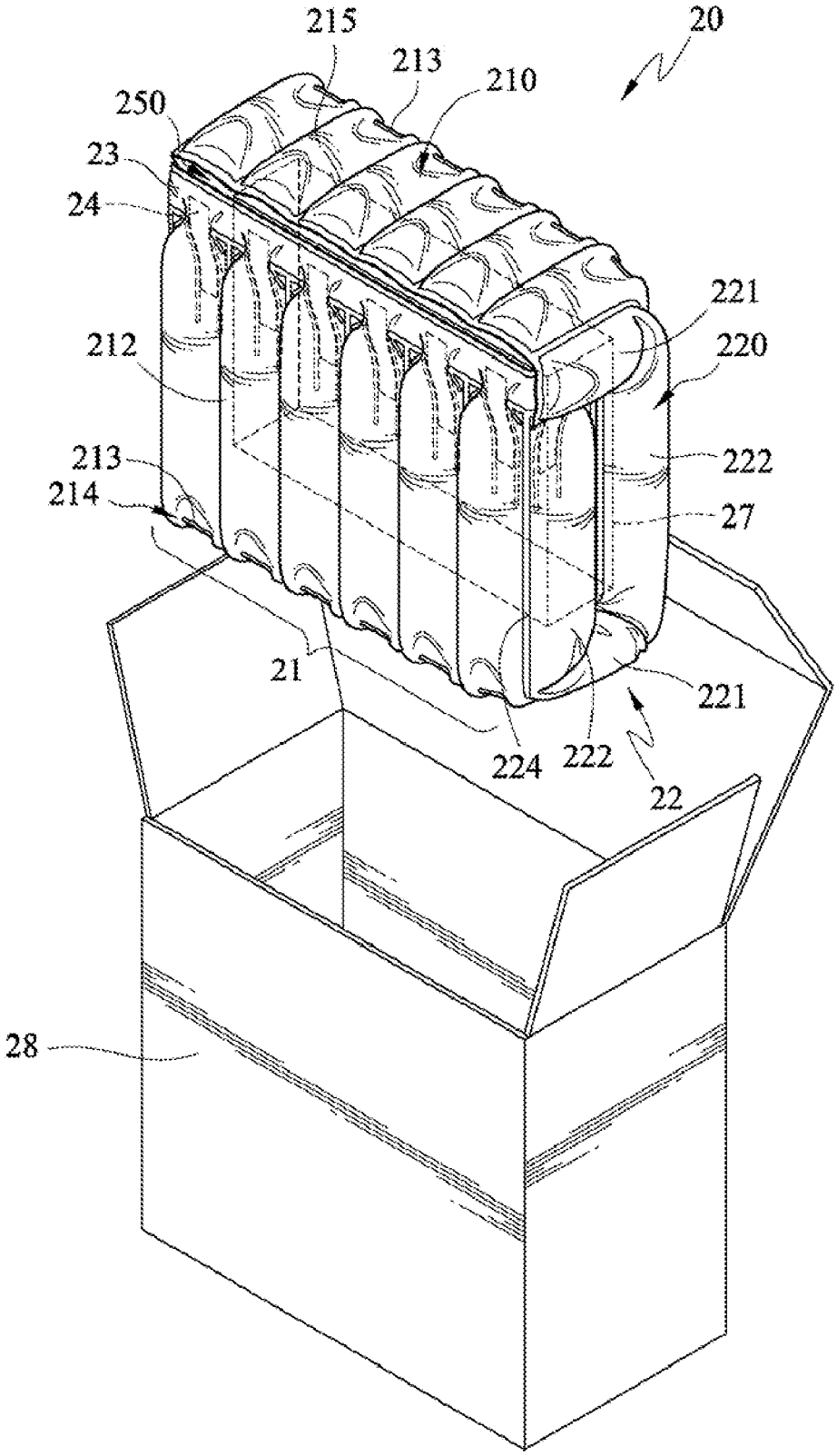
FIG. 11 is an explanatory diagram for FIG. 10, loading into a cardboard box after folding operation.

Please refer to FIGS. 10 and 11, which illustrate the fourth preferred embodiment. FIG. 10 is an explanatory diagram before filling air, while FIG. 11 is an explanatory diagram loading into the cardboard box after folding operation.

The main air tubes 210 of the main air tube piece 21 have two main bodies 211, along with a shared buffer wall 212 configured between the two main bodies 211, and one of the main bodies 211 having another buffer wall 212 at the other side. The side air tube 220 of the side air tube piece 22 has two side bodies 221 located adjacent to the two main bodies 211 respectively. A joint folding portion 222 is configured between the two side bodies 221; and one of the side bodies 221 has another folding portion 222 at the other side. Bending lines 214 are configured between the main bodies 211 and the buffer walls 212, and the side bodies 221 and the folding portions 222. The side air tube piece 22 equips with folding areas 223 adjacent to each of the intersections of the folding lines 224 and the bending lines 214.

When the main air tube piece 21 and the side air tube piece 22 are expanding with air-filling, the main air tube piece 21 is bended along the bending points 213 to allow one of the main bodies 211 and two buffer walls 212 to form a U-shaped body. One of the side bodies 221 of the side air tube piece 22 is folded along the folding areas 223, with the side air tube piece 22 folded along the folding line 224, to form the containing space 250 between the side bodies 221 of side air tube piece 22 and the folding portions 222, and the main bodies 211 of the main air tube piece 21 and the buffer walls 212. Meanwhile the other main body 211 is bended along the bending points 213 to form an opening for covering the U-shaped body, with the other side body 221 folded along the folding areas 223 to cover the held article 27. It is not only to provide the held article 27 the six-side buffering, but also to be easily loaded into the cardboard box 28.

Figure 12:
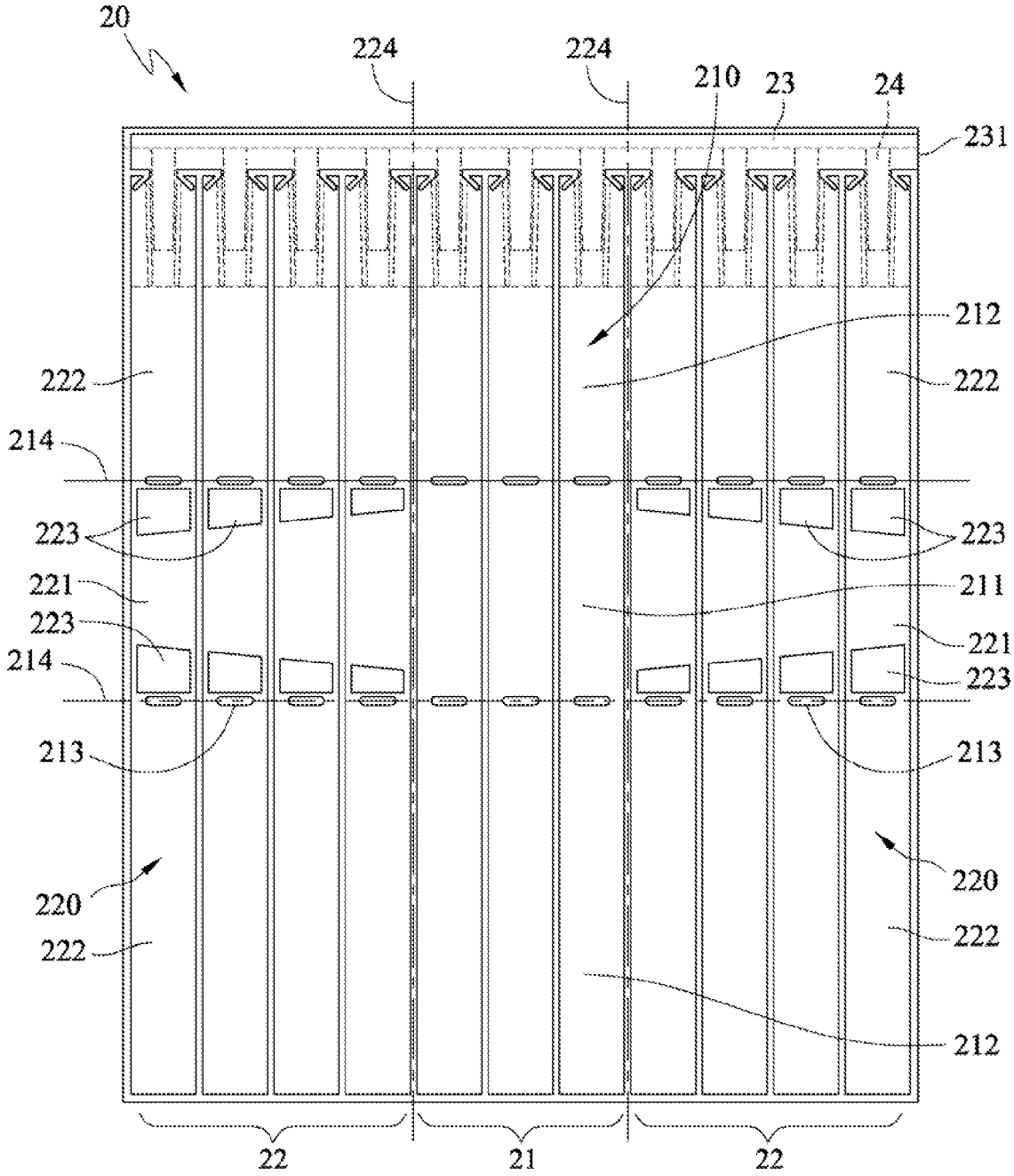
FIG. 12 is an explanatory diagram of the fifth preferred embodiment in the present invention.
Figure 13:
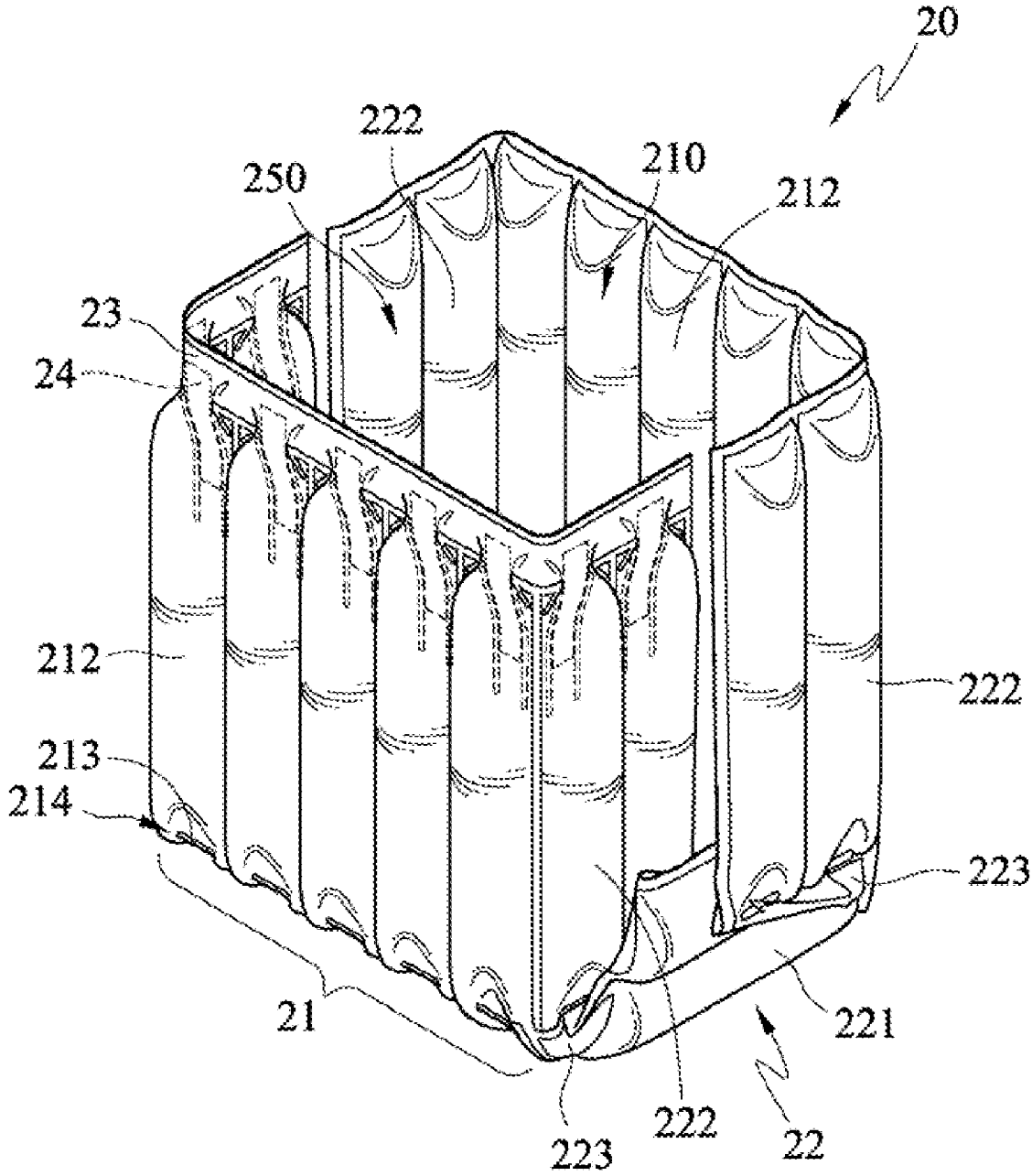
FIG. 13 is an explanatory diagram for FIG. 12, proceeding folding operation after filling air.

Please refer to FIGS. 12 and 13, which illustrate the fifth preferred embodiment. FIG. 12 is an explanatory diagram before filling air, while FIG. 13 is an explanatory diagram of folding operation after filling air.

The side air tube piece 22 is composed by plural side air tubes 220, wherein each of the side air tubes 220 has a side body 221 with folding portions 222 configured at the two lateral sides of the side body 221 respectively. Folding areas 223 with about quadrangle shape are configured on the side air tube piece 22, adjacent to the intersections of the folding lines 224 and the bending lines 214. One folding area 223 may be across-involved with several side air tubes 220; or each of the side air tubes 220 has its folding areas 223 with about quadrangle shape. The side body 221 of the side air tube piece 22 is folded along the folding areas 223, with the side air tube piece 22 folded along the folding lines 224. One of the folding portion 222 is located at the front side of the side body 221, with the other folding portion 222 configured at the rear side of the side body 221. Thus the containing space 250 is formed between the side body 221 of the side air tube piece 22 and the folding portions 222, and the main body 211 of the main air tube piece 21 and buffer walls 212.

When the held article 27 packed in the containing space 250 is falling to hit the ground or hit by a serious impact, with the two folding portions 222 configured at the opposite sides of the side body 221, the held article 27 will be provided with two times of buffering to increase the effect of buffering protection.

Furthermore, when the side body 221 of the side air tube piece 22 is folded along the folding areas 223, and the side air tube piece 22 is folded along the folding lines 224, the two folding portions 222 may be folded to the opposite sides of the side body 221 respectively, or to the front or rear side of the side body 221.

Figure 14:
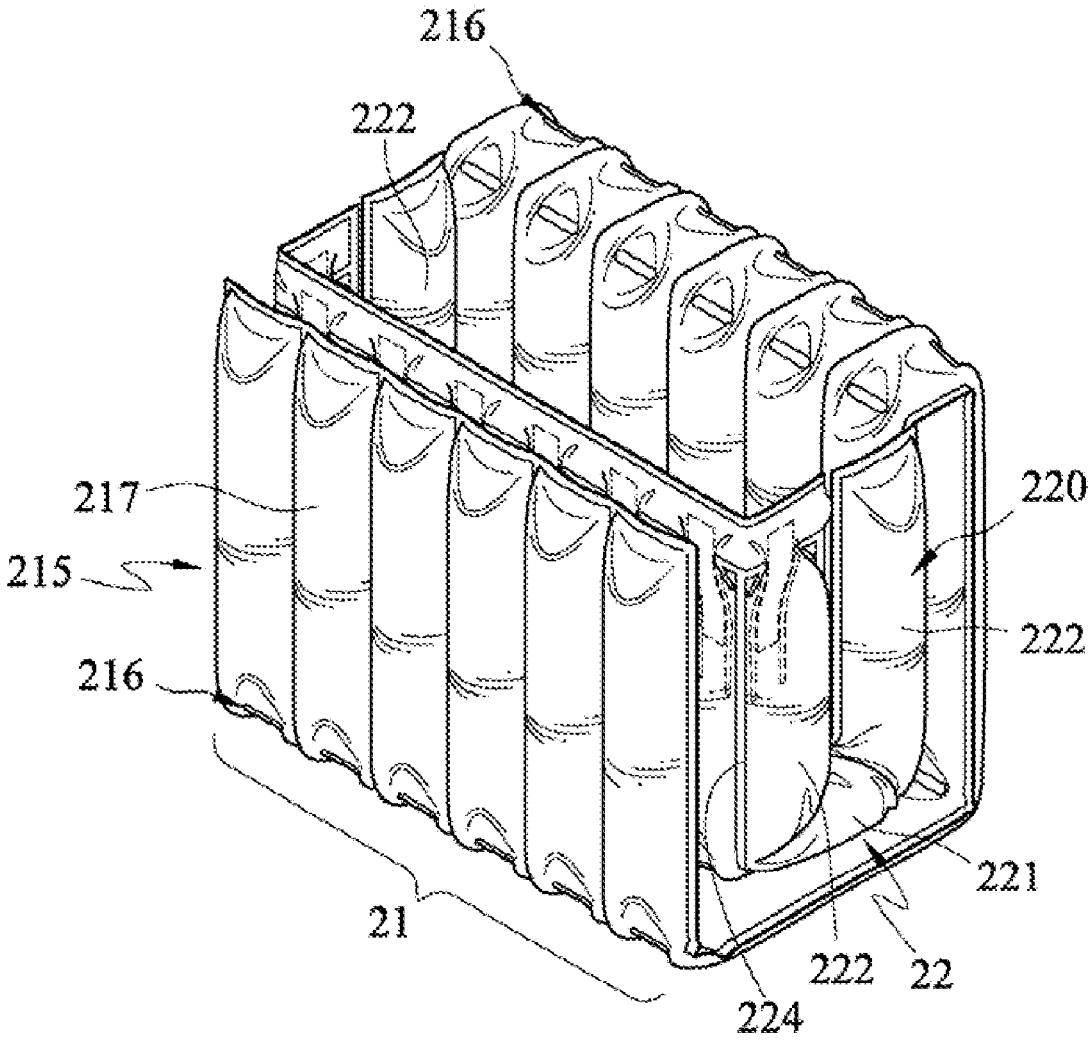
FIG. 14 is an explanatory diagram of the sixth preferred embodiment in the present invention.

Please refer to FIG. 14, which is an explanatory diagram of the sixth preferred embodiment.

The main air tube piece 21 further includes an enhanced portion 215, which has more than two sets of nodes 216 for folding and forming strengthened wall 217 to surround the main air tube piece 21, thereby raises the buffering effect of the main body 211 and the buffer walls 212 and achieves a strengthened effect of dual-layer buffer wall.

Accordingly, the present invention directly folds the main air tube piece 21 and the side air tube piece 22 as a container to load the held article 27. Not only the production procedures may be simplified, but also the manufacturing cost is substantially reduced. In addition, the side air tube piece 22 of the present invention is folded and bended along the folding areas 223, so as to provide the effect of lateral buffering protection for the held article 27, and to easily load the held article 27 into the external packing box along with the foldable air cushion 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A foldable air cushion, comprising:

a main air tube piece comprising a main body and at least one buffer wall connected to the main body, and having a first end and a second end opposite to the first end;

at least one side air tube piece, located at a side of the main air tube piece, the side air tube piece comprising a side body, and a folding portion connected to the side body, and having a first end and a second end opposite to the first end;

a pneumatic passage comprising a pneumatic hole and disposed adjacent to the first end of the main air tube piece and the first end of the side air tube piece;

each of the first end of the main air tube piece and the first end of the side air tube piece having a check valve disposed therein, the check valve individually connecting a respective one of the main air tube piece or the side air tube piece with the pneumatic air passage, allowing air to be filled in the pneumatic passage via the pneumatic hole, the air in the pneumatic passage concurrently entering and expanding the main air tube piece and the side air tube piece, and individually sealing each respective main air tube piece and side air tube piece, preventing the main air tube piece and the side air tube piece from leaking air;

a bending line, located between the main body and the buffer wall, and the side body and the folding portion;

a folding line, located between the main air tube piece and the side air tube piece; and a folding area, located on the side air tube piece and at the intersection of the bending line and the folding line, the folding area having a polygonal or irregular shape, wherein a vertex of the polygonal or irregular shape intersects at the intersection of the bending line and the folding line, said folding area having a width smaller than the width of the side air tube piece and being sealed around its entire periphery so as to be free of an air entrance that communicates between the folding area and the side air tube piece adjacent thereto;

wherein air is filled into the side air tube via the pneumatic passage and the check valve through a gap formed by the difference in widths between the folding area and the side air tube piece, the main air tube piece is bent along the bending line, the side body of the side air tube piece is folded along the folding area, and the side air tube piece is folded along the folding line, thereby forming a containing space between the main air tube piece and the side air tube piece.

2. The foldable air cushion of claim 1, wherein the main air tube piece further comprises at least one bending point, located between the buffer wall and the main body for bending to form the bending line.

3. The foldable air cushion of claim 1, wherein the main air tube piece comprises at least two buffer walls, and two opposite sides of the main body respectively connect to each of the buffer walls to form a U-shaped body through bending.

4. The foldable air cushion of claim 1, wherein the main air tube piece comprises at least two buffer walls, a first main body having two ends respectively connecting to each of the buffer walls, and a second main body having only one end connecting to one of the buffer walls.

5. The foldable air cushion of claim 4, wherein the side air tube piece comprises a first side body and a second side body located respectively at a side of the first main body and the second main body, the first side body having two ends connecting to the folding portions, and the second side body having only one end connecting to the folding portion.

6. The foldable air cushion of claim 1, wherein the buffer wall further comprises an enhanced portion with more than two sets of nodes for folding as a strengthened wall to surround the main air tube piece.

7. The foldable air cushion of claim 1, wherein each main air tube piece further comprises at least one main air tube.

8. The foldable air cushion of claim 7, wherein the main air tubes have the same or various lengths, or a mixture thereof.

9. The foldable air cushion of claim 7, wherein the main air tubes have the same or various widths, or a mixture thereof.

10. The foldable air cushion of claim 7, wherein the main air tube is straight or curve, or a mixture thereof.

11. The foldable air cushion of claim 1, wherein the shape of the bending point is selected from the group consisting of triangular, elliptical, circular, square, and irregular shapes.

12. The foldable air cushion of claim 1, wherein the shape of the folding area is selected from the group consisting of triangular, elliptical, circular, and square.

13. The foldable air cushion of claim 1, wherein each side air tube piece further comprises at least one side air tube.

14. The foldable air cushion of claim 13, wherein the side air tubes have the same or various lengths, or a mixture thereof.

15. The foldable air cushion of claim 13, wherein the side air tubes have the same or various widths, or a mixture thereof.

16. The foldable air cushion of claim 13, wherein the side air tubes are straight or curve, or a mixture thereof.

17. The foldable air cushion of claim 1, wherein a containing space is formed between the side body of the side air tube piece and the folding portion, and the main body of the main air tube piece and the buffer wall.

18. The foldable air cushion of claim 1, wherein at least one portion of the side air tube piece is held in the containing space.

19. The foldable air cushion of claim 1, wherein when the air is filled into the side air tube, an inside of the folding area is free of the air filled via the pneumatic passage and the check valve.

20. The foldable air cushion of claim 1, wherein an entire area of the folding area is a sealing area.

21. The foldable air cushion of claim 1, wherein before filling air into the foldable air cushion, the folding line is a straight line intersecting with the bending line at 90°.

22. The foldable air cushion of claim 1, wherein when the air is filled into the side air tube, the folding area is non-expandable by way of air-filling.

* * * * *